US005683257A

United States Patent [19]

Kobayashi et al.

[11] Patent Number: 5,683,257

[45] Date of Patent: Nov. 4, 1997

[54] RETAINER FOR HOLDING TERMINALS IN A UNIT STRUCTURE AND METHOD OF USE THEREOF

[75] Inventors: Takashi Kobayashi; Masayoshi Imoto, both of Yokkaichi, Japan

[73] Assignee: Sumitomo Wiring Systems, Ltd., Japan

[21] Appl. No.: 751,318

[22] Filed: Nov. 18, 1996

Related U.S. Application Data

[62] Division of Ser. No. 525,220, Sep. 8, 1995, Pat. No. 5,617,630.

[30] Foreign Application Priority Data

Sep. 14, 1994 [JP] Japan ..... 6-220547

[51] Int. Cl.[6] ..... H01R 9/09

[52] U.S. Cl. ..... 439/76.2; 439/747; 29/857

[58] Field of Search ..... 439/747, 76.2, 439/449, 470, 590, 892.2; 29/857, 861, 868

[56] References Cited

U.S. PATENT DOCUMENTS

| | | | |
|---|---|---|---|
| 3,720,907 | 3/1973 | Asick | 439/747 |
| 4,346,959 | 8/1982 | Daugherty et al. | 439/747 |
| 4,379,611 | 4/1983 | Foege et al. | 439/747 |
| 4,529,260 | 7/1985 | Smith | 439/747 |
| 5,383,800 | 1/1995 | Saka et al. | 439/76.2 |

*Primary Examiner*—Gary F. Paumen

*Attorney, Agent, or Firm*—Bierman, Muserlian and Lucas LLP

[57] ABSTRACT

Terminals of a wire harness are sorted for each contact of a unit structure to which the terminals are to be connected. The sorted terminals are temporarily held by a jig in a configuration which matches the arrangement in which they are to be connected to the corresponding contacts. The, terminals are arranged in rows in the proper connection arrangement, and are transferred to the contacts and connected in this state. A retainer is then placed in the unit structure containing the connected terminals, thereby holding them in place. It is consequently possible to reduce the frequency of erroneous insertion, and to improve operating performance markedly.

3 Claims, 15 Drawing Sheets

RETAINER FOR HOLDING TERMINALS IN A UNIT STRUCTURE AND METHOD OF USE THEREOF

This is a Division of Ser. No. 525,220 filed Sep. 8, 1995, now U.S. Pat. No. 5,617,630 issued Apr. 8, 1997.

This Application claims the priority of Japanese Application 6-220547, filed Sep. 14, 1994.

The present Invention relates to a unit structure and wire harness connection, as well as a method of assembly thereof. More particularly, it is directed to such a structure which is most suitable for the manufacture of complex wire harnesses and for permanently mounting the terminals thereof. An assembly method is also within the scope of the Invention.

BACKGROUND OF THE INVENTION

In general, a wire harness is an electric wiring system containing a number of cables, often as many as 400–500 circuits. When producing such large scale wire harnesses, a plurality of unit cable binding assemblies (called temporary binding circuits) is first manufactured. These are then electrically connected by various means by what is called a final binding process. As the last step in the binding process, a plurality of terminals must be permanently and accurately inserted into a unit structure.

These structures have a main casing within which the contacts are arranged for connection to the terminals of the wire harness. An open component is preferably molded to the main casing and permits the terminals to mate with the contacts. Such structures are described in, for example, "Electronic Device Housing for Vehicles" (Japanese Laid-Open Utility Model 61-134455), "Joint Box" (Japanese Laid-Open Utility Model 61-96717), "Wire Connector" (Japanese Laid-Open Utility Model 60-2331), and "Connector-Equipped Electronic Device" (Japanese Laid-Open Utility Model 63-128778). In the past, when connecting a wire harness to such a unit structure, a female or male connector was integrally molded to the unit structure, and a complementary connector was integrally molded to the wire harness, and the two connectors were then mated to connect the harness to the unit structure. With this method, however, since it is necessary to mold the connectors to both the unit structure and the wire harness, the number of components, as well as the production cost, is increased.

To solve this problem, a method has been proposed (Japanese Laid-Open Patent Application 62-16009) in which a connector housing, into which the terminals are directly inserted after attachment to the cables, is integrally provided adjacent the connection to the unit structure, and the terminals are inserted therein. Since the terminals are inserted directly into the connector housing, a latch is integrally molded in the housing to prevent the terminals from detaching. However, the integral molding is a difficult and expensive operation.

Moreover, connecting the wire housing to the unit structure has not yet been automated. For this reason, the worker must manually insert the terminals into the connector housing. Since the arrangement of the terminals is not specified, the worker must at this time check the contacts in the housing into which each terminal is to be inserted, thus creating a situation in which connection errors are likely.

SUMMARY OF THE INVENTION

In light of the aforementioned problems, it is the object of the Invention to provide a unit structure, a method of assembly thereof, and a retainer for holding the terminals in place, which permit easy assembly, minimize opportunities for misconnection, and effect economies of production and operation.

First, the terminals are sorted so that they match the contacts in the open component of the unit structure. Thereafter, the sorted terminals are temporarily held in a holding jig which retains them in a configuration which matches that of the corresponding contacts in the open component. Then, the terminals are transferred out of the jig into the contact chamber of the open components and into electrical contact with the contacts. Finally, a retainer is introduced into the contact chamber, thereby securing the terminals in their connected position.

The present Invention comprises a unit structure having a main casing, a plurality of contacts therein for connection to corresponding terminals of a wire harness, and an open component, preferably integrally molded with the main casing, permitting electrical connection of the terminals to the contacts.

When the terminals have been inserted into the unit structure, the cables attached thereto are in the receiving chambers. They are removed by passing them through gaps in the chambers provided for this purpose. If some terminals have been inserted into the connector in advance, the cables to which they are attached can be readily inserted and/or removed through the gap. The Invention makes it possible to transfer the terminal fittings to the contacts simply by introducing the holding jig into the open component. Since the retainer is separate from the open component, it is not necessary to mold a stop component into the main casing, thereby simplifying the shape and production thereof.

BRIEF DESCRIPTION OF THE DRAWINGS

In the accompanying drawings, constituting a part hereof and in which like reference characters indicate like parts.

DETAILED DESCRIPTION OF THE INVENTION

Figure 1:
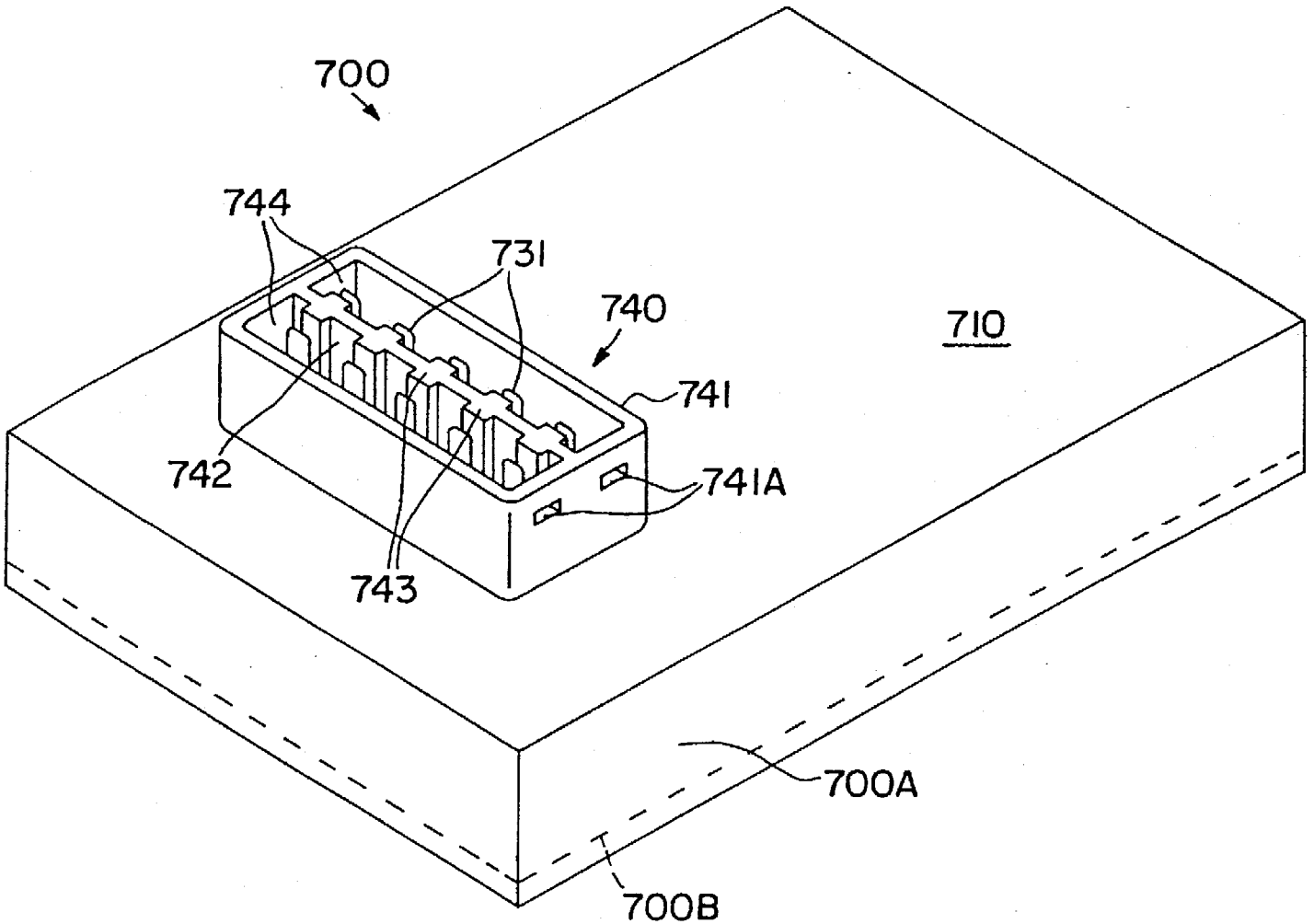
FIG. 1 is a perspective view of the exterior of the unit structure of the present Invention.
Figure 2:
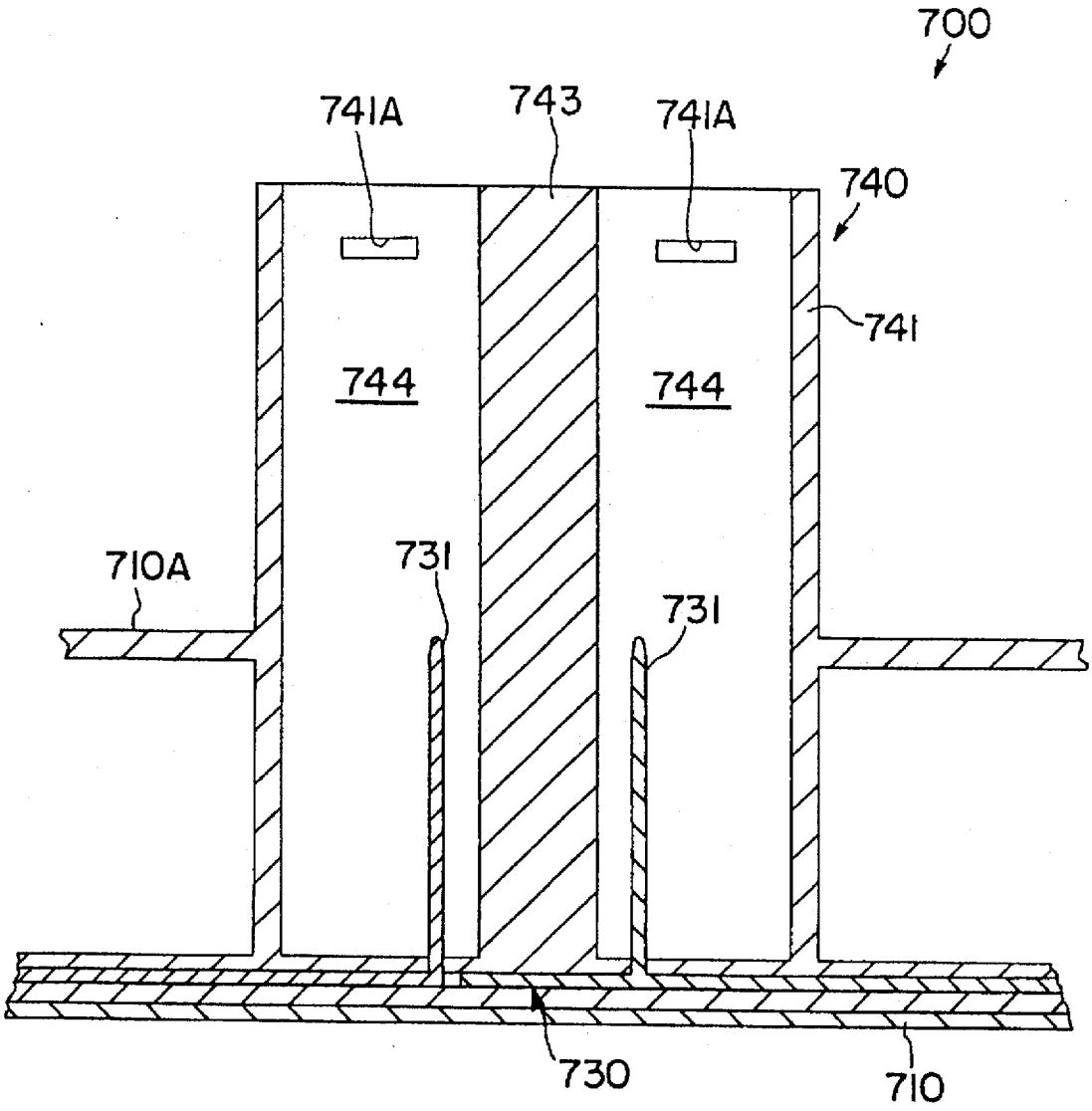
FIG. 2 is a cross-section of the unit structure of FIG. 1.

Unit structure 700 has main casing 710, divided into lower cover 700B and upper cover 700A, lower cover 700B being open to upper cover 700A. Main casing 710 houses a plurality of bus bars 730, of which only two are shown in FIG. 2. Bus bars 730 are laminated in an electrically-insulated state, and are furnished with contacts 731. Terminals 31A of wire harness WH are to be connected thereto. Open component 740 guides holding jig 147 into contact chamber 744; this, in turn, guides terminals 31A, held by holding jig 147, to the corresponding tab contacts 731. Preferably, component 740 is integrally molded with main casing 710.

Open component 740 is furnished with outer wall 741 which is substantially rectangular when viewed in plan and encloses contacts 731. In the preferred embodiment shown herein, contacts 731 are arranged in two rows. Contact chamber 744 is divided in two down the center by partition plate 742 which extends lengthwise thereof and separates the two rows of tab contacts 731. Columns 743, molded at intervals and connected to plate 742, are substantially rectangular in plan, and plate 742 passes through the approximate center thereof. Columns 743 face tab contacts 731 in the widthwise direction of outer wall 741.

Contact chamber 744 is defined by outer wall 741, plate 742, and columns 743 connected thereto. Lances for stopping terminal fittings 31A when connected to tab contacts 731 are not formed in chamber 744, and this chamber is defined by a simple wall configuration. Chamber 744 houses terminals 31A when inserted and these terminals are held in place by a retainer 750 (see FIG. 14).

More specifically, holding jig 147 temporarily holds female terminals 31A which are to be connected to male terminals (not shown) and are integrally equipped with tip T1. Barrel T2 is crimped on the end of cable 31. Between tip T1 and barrel T2, there is a pair of stabilizers T3, and terminals 31A are also provided with lance holes T4 as stops. Holding jig 147 comprises main body 147A of generally rectangular plate form. Main body 147A is preferably resin molded with an integral pair of side walls 147B and a plurality of partitions 147C parallel to side walls 147B and spaced apart from each other. Between side walls 147B and the adjacent partitions 147C, as well as between adjacent partitions 147C, terminal receiving chambers 147E accommodate terminals 31A.

Cross pieces 147F extend parallel to the plane of main body 147A and are desirably integral therewith. Each receiving chamber 147E is in channel form with a U-shaped cross section. The upper edge of each chamber 147E comprises a terminal entry 147G for insertion of terminal 31A lead by tip T1. The lower edge (see FIGS. 3 and 4) comprises terminal exit 147H to allow terminals 31A to be removed therethrough. Thus, entry 147G and exit 147H allow terminals 31A to enter and leave receiving chamber 147E by movement thereof in one direction. Each of cross-pieces 147F is spaced apart from its adjacent cross piece 147F by gap 147L. Gap 147L constitutes an opening through which cable 31 may pass both inwardly and outwardly.

Receiving chambers 147E are provided with ribs 147J extending from entry 147G to exit 147H and are advantageously integrally formed with chambers 147E. Each rib 147J comprises inclined surface J1, which guides terminal 31A as it is introduced into chamber 147E through entry 147G in a terminal entering direction (arrow A1 in FIGS. 3 and 4). Thereafter, ramp J2, which rises smoothly away from body 147A, guides terminals 31A so that edge J3 is resiliently pressed toward main body 147A. Contiguous to ramp J2 is stop J4, which is adapted to enter lance hole T4 when terminal 31A is fully in chamber 147E. Thus, rib 147J and stop J4 cooperate to allow terminal 31A to be temporarily held in receiving chamber 147E and to release terminal 31A when terminal 31A is urged in the terminal entering direction A1.

Figure 3:
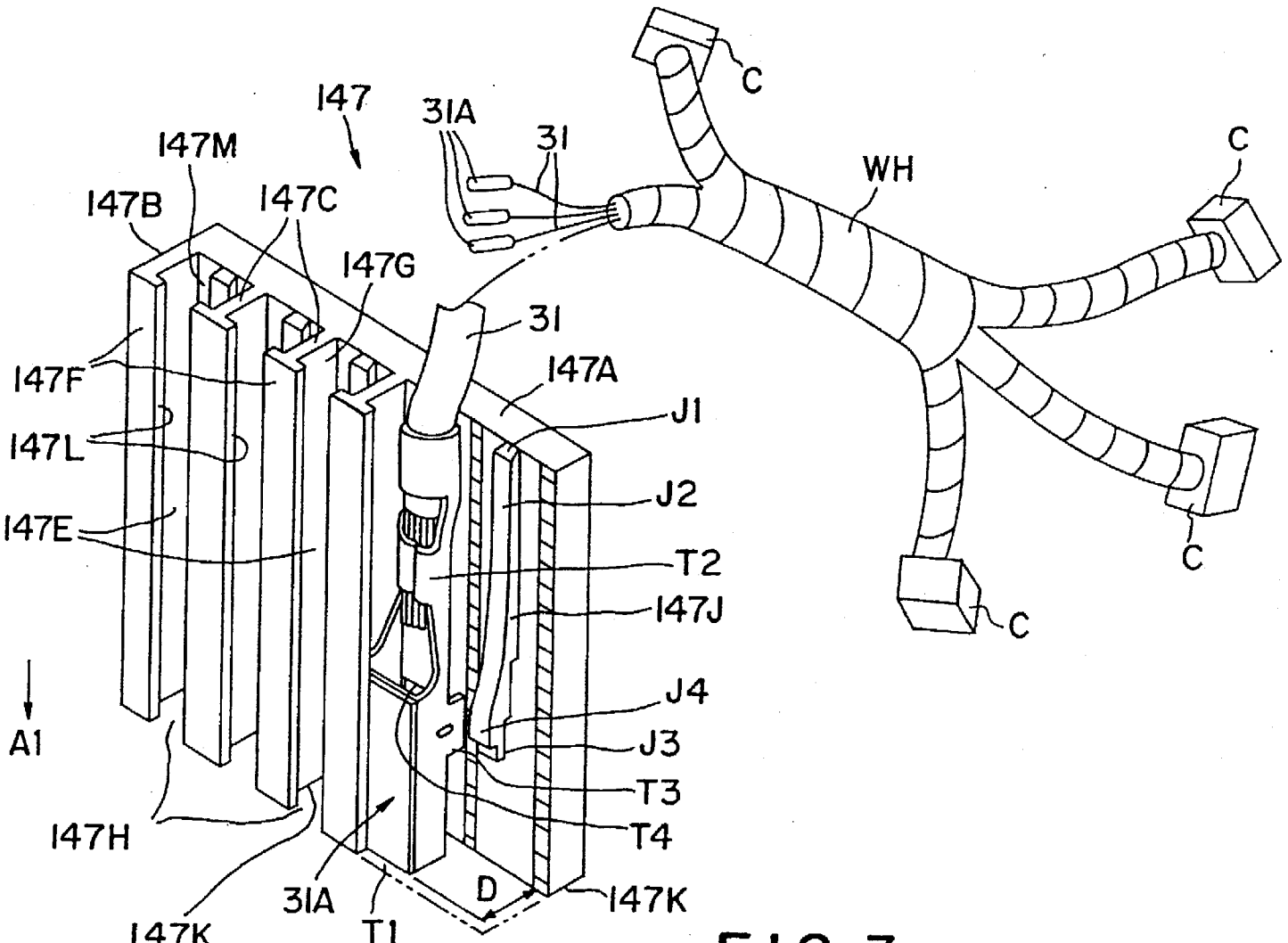
FIG. 3 is a perspective view of a wire harness and the holding jig of the present Invention.

With reference to FIG. 3, when tip T1 of terminal 31A enters entry 147G and moves into receiving chamber 147E along ramp J2, stop J4 is displaced toward main body 147A as a result of resilient deflection of edge J3, thereby allowing terminal 31A to enter. When stop J4 is opposite lance hole T4, it enters hole T4 and terminal 31A is firmly held between side walls 147B, partitions 147C, main body 147A, a cross pieces 147F, by the elasticity of edge J3.

Figure 4:
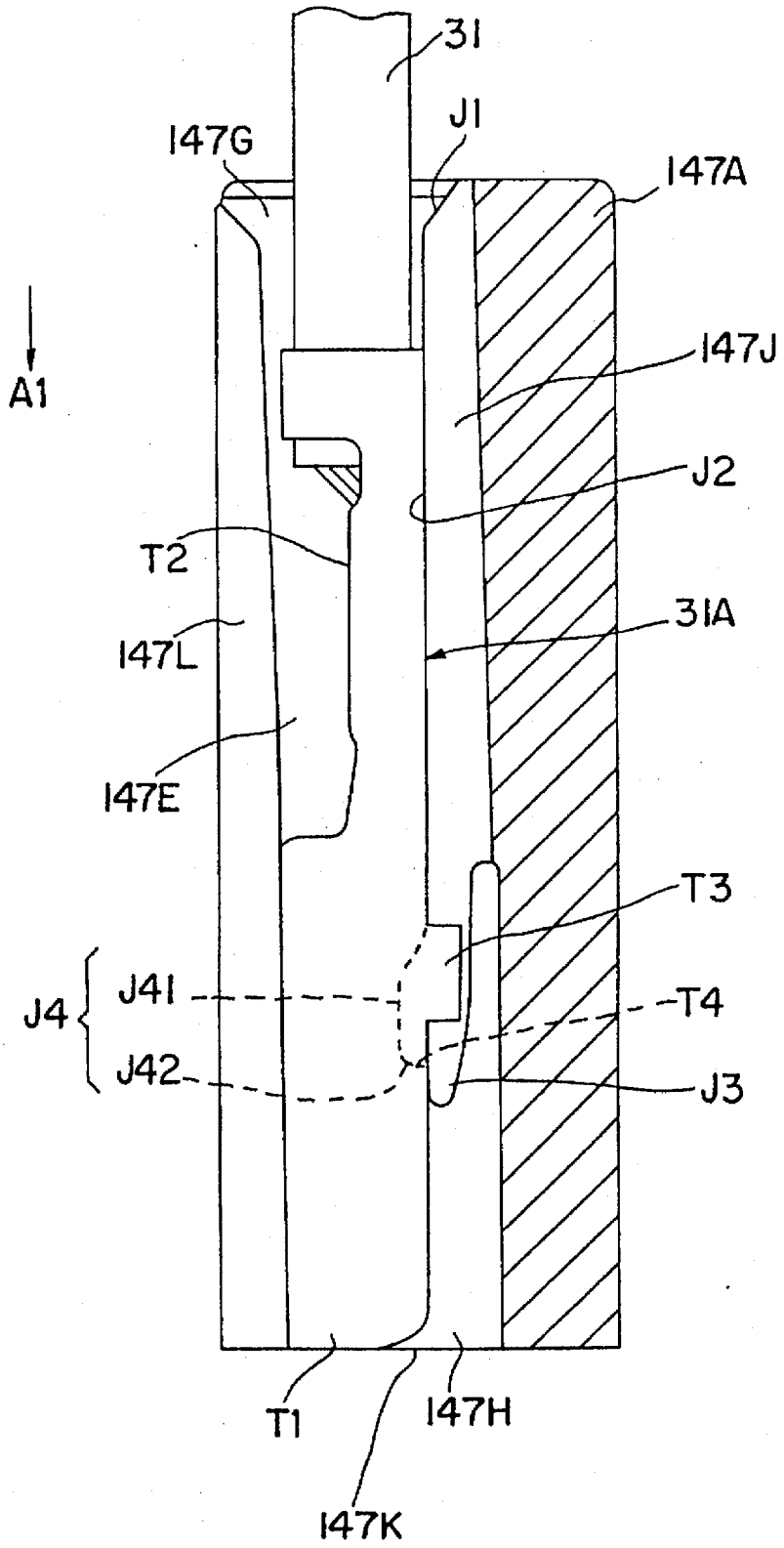
FIG. 4 is a vertical cross-section of the holding jig of FIG. 3.

The back side of guide J41, which guides the lower surface of tip T1, is smoothly connected to ramp J2 and shoulder J42, as shown in FIG. 4. As terminals 31A move in direction A1, after being temporarily held, the back face of guide J41 is displaced by the rim of lance hole T4, thereby releasing stop J4. However, if terminal 31A is pulled towards entry 147G, shoulder J42 bears against lance hole T4 and prevents movement of terminal 31A. Therefore, terminal 31A will not release in this direction. Moreover, if it is attempted to introduce 31A from exit 147H, shoulder J42 of stop member J4 contacts terminal 31A and prevents entry. Therefore, even if an operator tries to manually insert terminal 31A into holding jig 147 from the wrong direction, stop J4 will prevent the error.

In a further refinement of the Invention, as shown in FIG. 3, a pair of entry slots 147M, which receive stabilizers T3, is provided. Cross pieces 147F define depth D (FIG. 5) of slot 147M so that terminal 31A can enter receiving chamber 147E only when stabilizer T3 is properly positioned. Thus, the insertion position of terminal 31A is uniformly defined, and mistakes by the operator are prevented. Although not shown in detail in the figure, connection ports for receiving tab contacts 731 of bus bars 730 and stop members for stopping the aforementioned tab contacts are integrally molded to tips T1. The formation of stop J4 on the and of rib 147J allows the rib and the stop to temporarily hold terminal 31A in receiving chamber 147E and releases terminal 31A when it is moved towards exit 147H.

Figure 6:
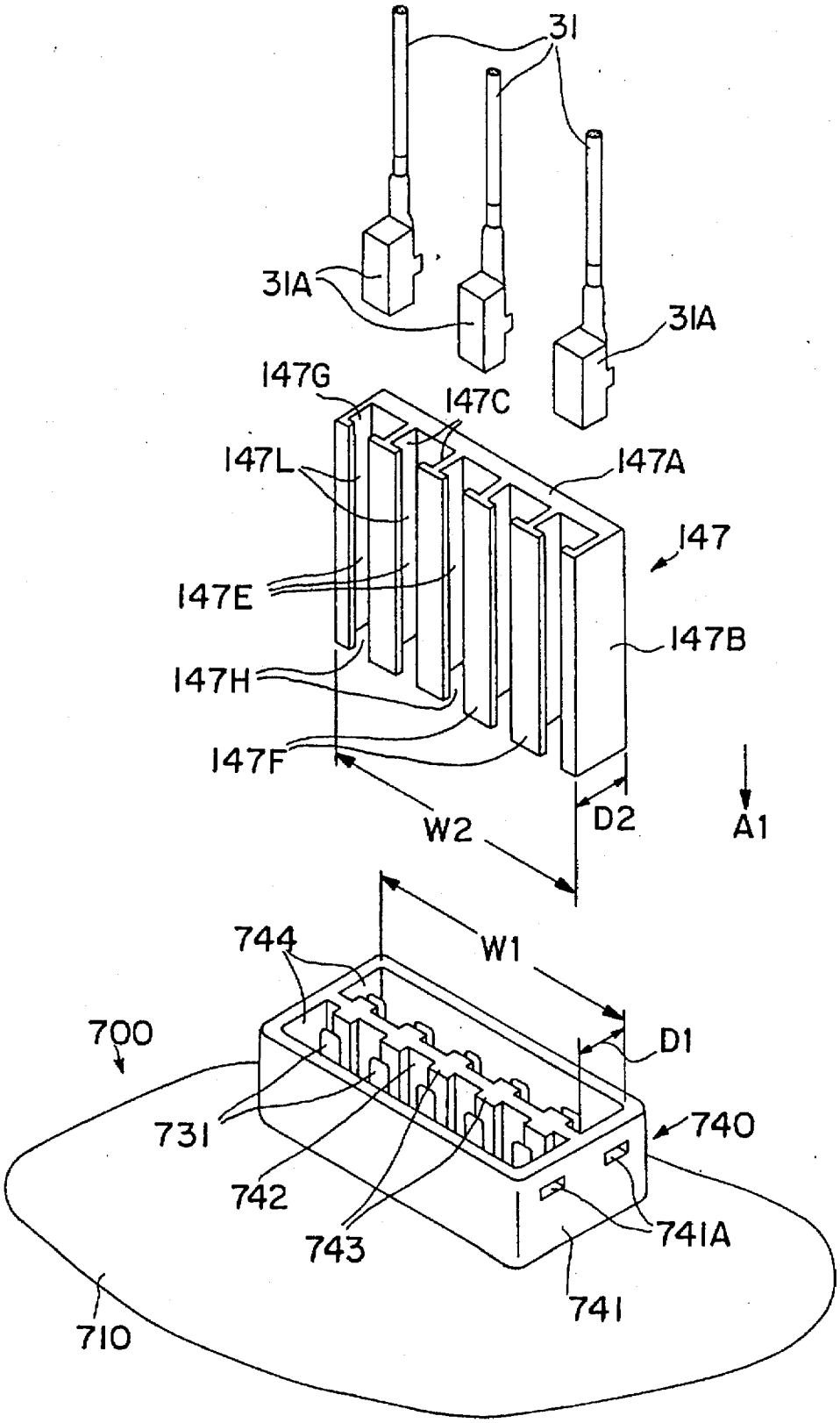
FIG. 6 is a perspective view of the terminals, holding jig and open component of the present Invention before assembly.

Referring to FIG. 6, width W1 and depth D1 in the lengthwise direction of chamber 744 of unit structure 700 correspond to width W2 and depth D2 of main body 147A of temporary holding jig 147, and columns 743 in plate 742 protrude in staggered fashion so that they can slide into gaps 147L in holding jig 147.

As shown in FIG. 3, wire harness WH comprises a plurality of cables 31 having terminals 31A electrically connected thereto, cables 31 also being attached to various specified connectors C. Wire harness WH, disclosed in Japanese Application 6/203973, is produced (for example) by measuring cables 31, stripping their ends, crimping terminals 31A thereto, insertion of terminals 31A into holding jig 147 or into connectors C, inspection for continuity, and assembly.

When end T1 of terminal 31A is introduced through entry 147G into receiving chamber 147E along ramp J2, end J3 is bent towards main body 147A. This results in latch J4 being displaced towards main body 147A, thereby permitting introduction of terminal 31A. When stop J4 faces lance hole T4, it engages lance hole T4, resulting in terminal 31A being held against cross pieces 147F by the elasticity of edge J3.

As shown in FIG. 4, stop J4 connects smoothly to ramp J2, and defines guide J41 which directs the bottom of tip T1 of terminal 31A to shoulder J42 at the end of guide J41. Thus, once terminal 31A is temporarily held, when it is pushed in the direction of exit 147H, guide J41 allows the smooth displacement of the open side of lance hole T4, whereby terminal 31A disengages from stop J4. On the other hand, when terminal 31A is pulled towards entry 147G, shoulder J42 engages lance hole T4, preventing terminal 31A from disengaging; thus, terminal 31A is not released from its temporary holding position. Furthermore, once terminal 31A passed through exit 147H, shoulder part J42 comes into contact with terminal 31A.

Figure 5:
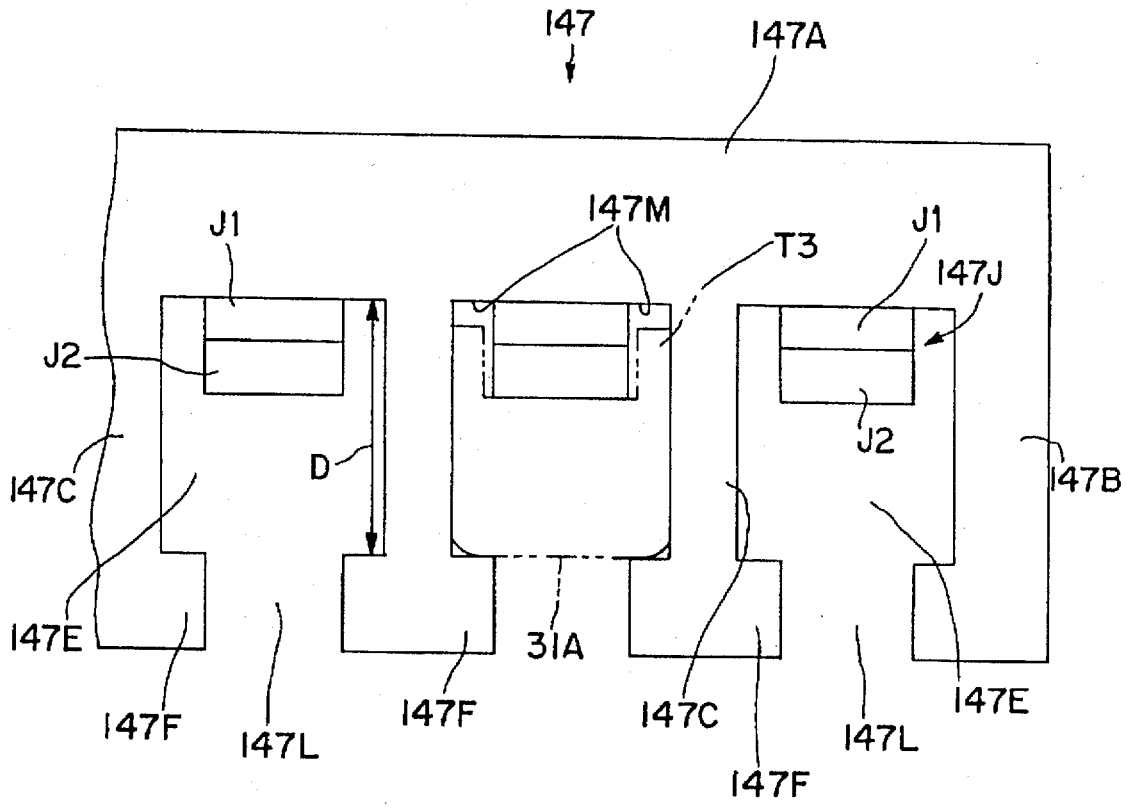
FIG. 5 is a plan view of the holding jig of FIG. 3.

Furthermore, as shown in FIG. 5, rib 147J defines, with receiving chamber 147E, a pair of entry slots of depth D which guide stabilizers T3. Referring to FIGS. 3 and 4, the same dimensions are established for the main body 147A, side walls 147B, and partition plates 147C in the lengthwise direction of the terminal housing chamber 147E, and lower end 147K in each figure is set flush with tip T1 of terminal 31A.

When terminals 31A are introduced into receiving chamber 147E, each terminal 31A is held inside receiving chamber 147E by stop J4. Receiving chambers 147E correspond to tab contacts 731 of unit structure 700 so that, as shown in FIG. 7, each terminal 31A is held in a configuration in which it is to be connected to unit structure 700 (see FIG. 6).

Figure 7:
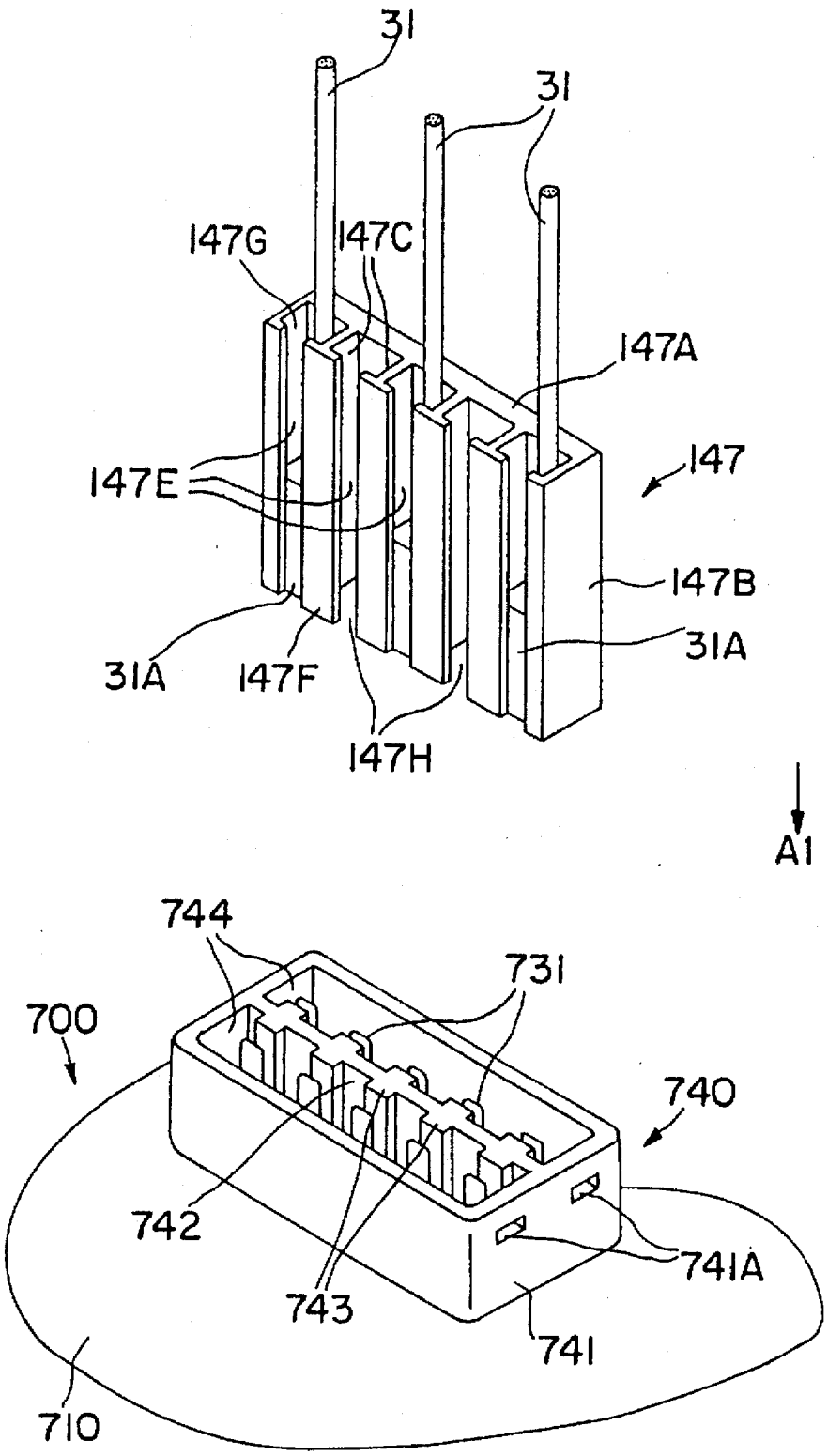
FIG. 7 is a perspective view, similar to that of FIG. 6, showing the terminals in the jig.
Figure 8:
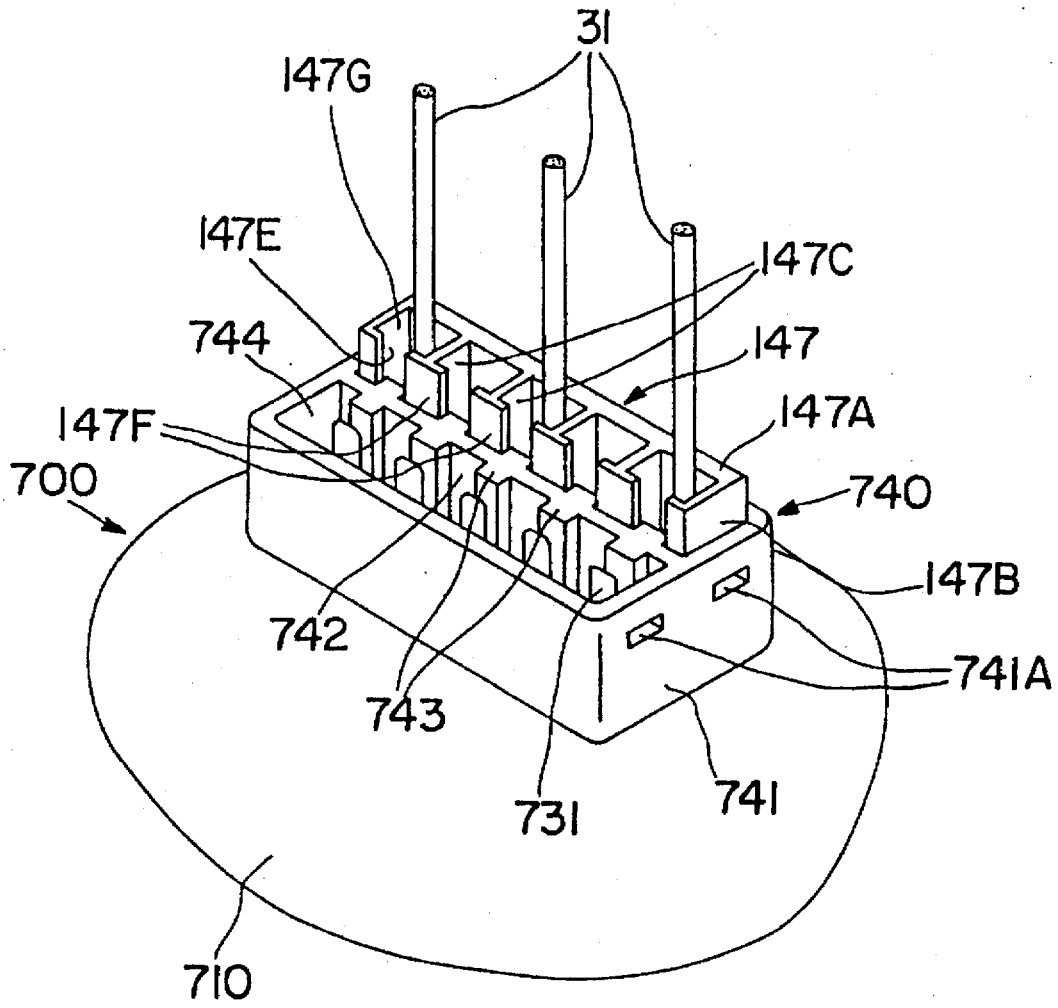
FIG. 8 is a perspective view, similar to that of FIG. 7, showing the jig inserted into the open component of the unit structure.
Figure 9:
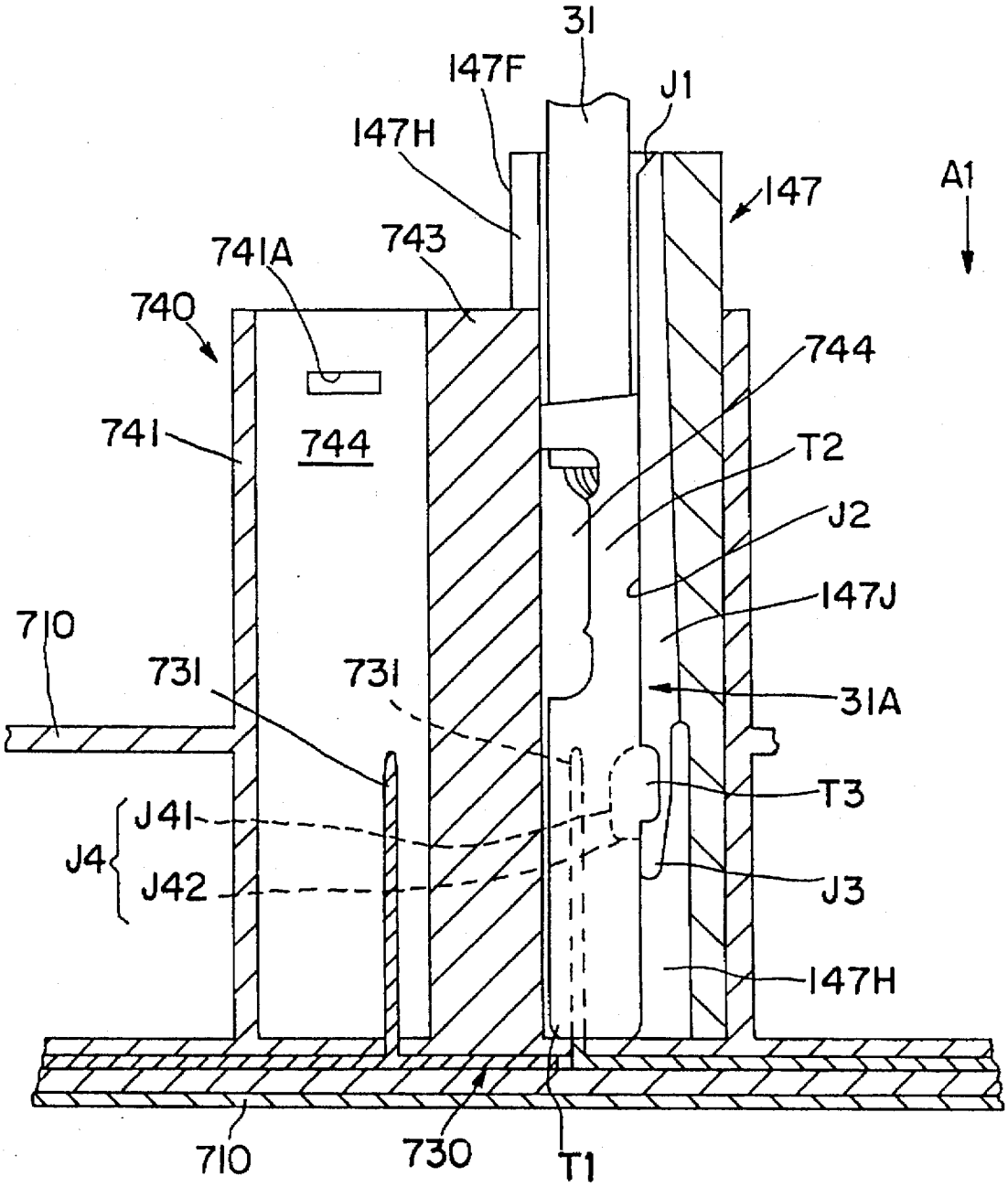
FIG. 9 is a cross-section of the unit structure and holding jig of FIG. 8.

Next, referring to FIG. 7, jig 147, which temporarily holds the terminal fittings 31A, is transported to the corresponding unit structure 700. There is no stop on unit structure 700, which therefore allows the uninserted tab contacts 731 to guide holding jig 147 into contact chamber 744. Thus, insertion of holding jig 147 into chamber 744 permits terminals 31A to be transferred to component 740.

As shown in FIG. 6, since width W1 and depth D1 in the lengthwise direction of chamber 744 are matched to width W2 and depth D2 of main body 147A, and columns 743 on partition plate 742 protrude so that they can slide into gaps 147L, cross pieces 147F face partition plate 742 of the unit structure 700. Holding jig 147 is pushed in the direction of arrow A1 with columns 743 fitted into gaps 147L, whereby terminals 31A, temporarily held by holding jig 147, are guided to corresponding tab contacts 731, thereby connecting all terminals 31A with their corresponding contacts 731. Thus, terminals 31A and contacts 731 connect to form the desired circuits. Each terminal 31A is thus housed in chamber 744 of unit structure 700 and connected to the corresponding tab contact. In this position, terminals 31A maintain their connections due to the frictional resistance between contacts 731 and the unillustrated stops.

In this configuration, when holding jig 147 is withdrawn in the opposite direction to that of arrow A1, the displacement of guide J41 relative to the open side of lance hole T4 occurs easily, terminals 31A are released, and holding jig 147 is withdrawn upwards. This operation may be carried out manually by the operator or by the use of automatic equipment. When holding jig 147 has been completely inserted into chamber 744 of unit structure 700, the upper end of holding jig 147 projects slightly out. This allows the exposed part of holding jig 147 to be grasped, and permits holding jig 147 to be easily inserted and withdrawn.

Figure 10:
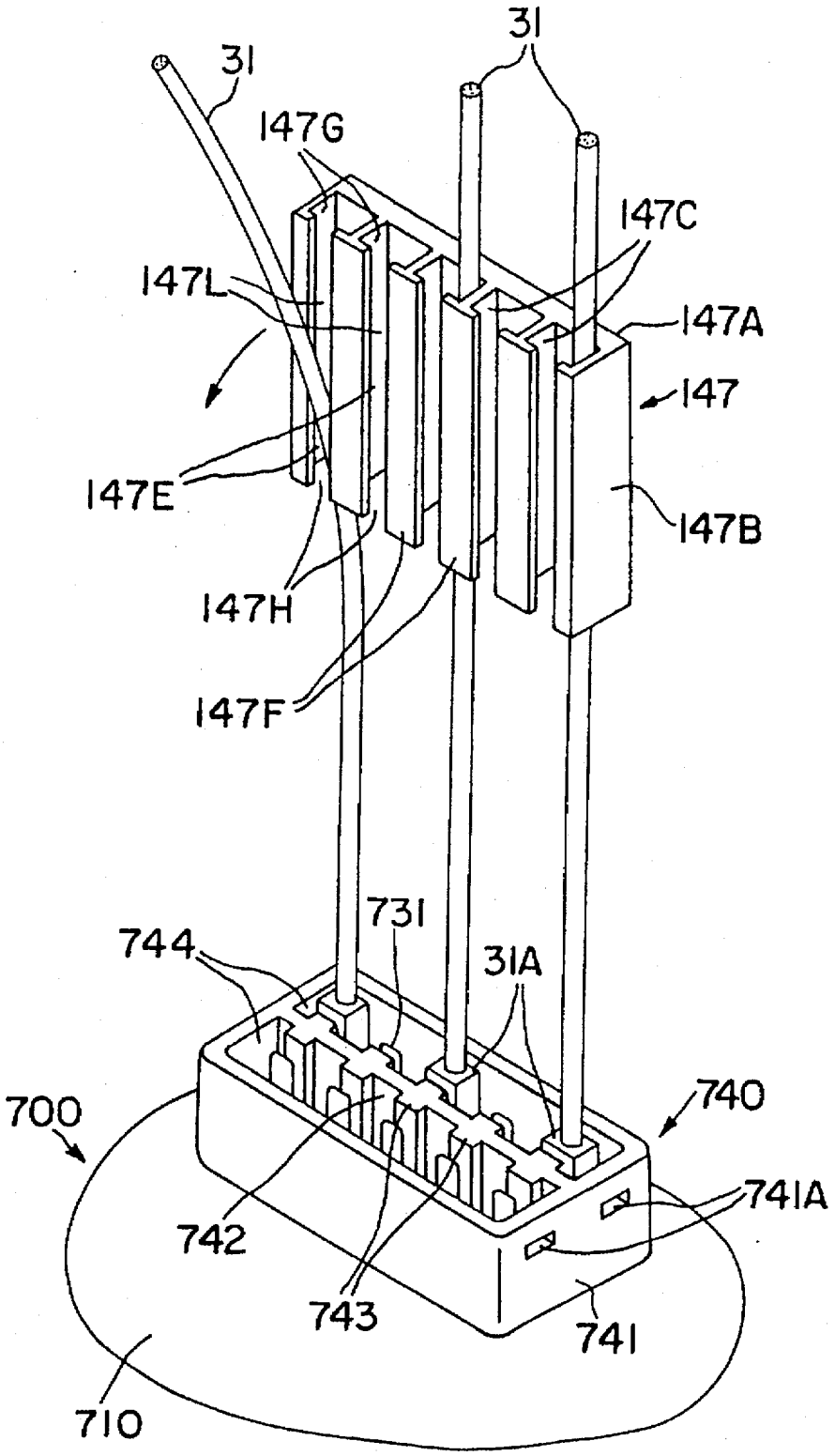
FIG. 10 is a perspective view showing the removal of the holding jig from the open component.
Figure 11:
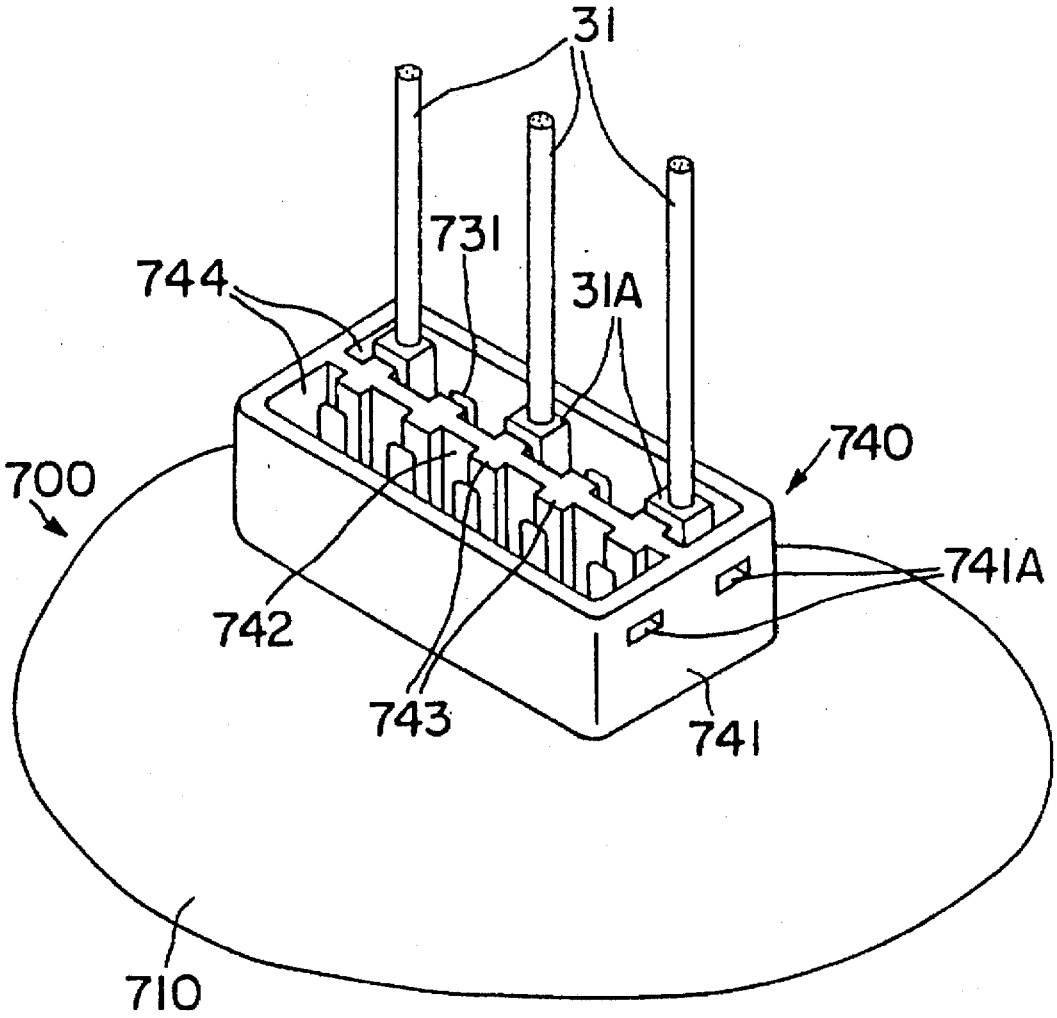
FIG. 11 is a perspective view of the open component after the holding jig has been withdrawn from the open component.

Referring to FIGS. 10 and 11, when terminals 31A are connected to unit structure 700 and holding jig 147 is withdrawn, cables 31 are in chamber 147E. These cables 31 are removed from chamber 147E through gaps 147L. The repetition of the aforementioned operation for each holding jig 147 allows terminals 31A, sorted by group, to be connected in proper order to the desired contacts 731.

Figure 12:
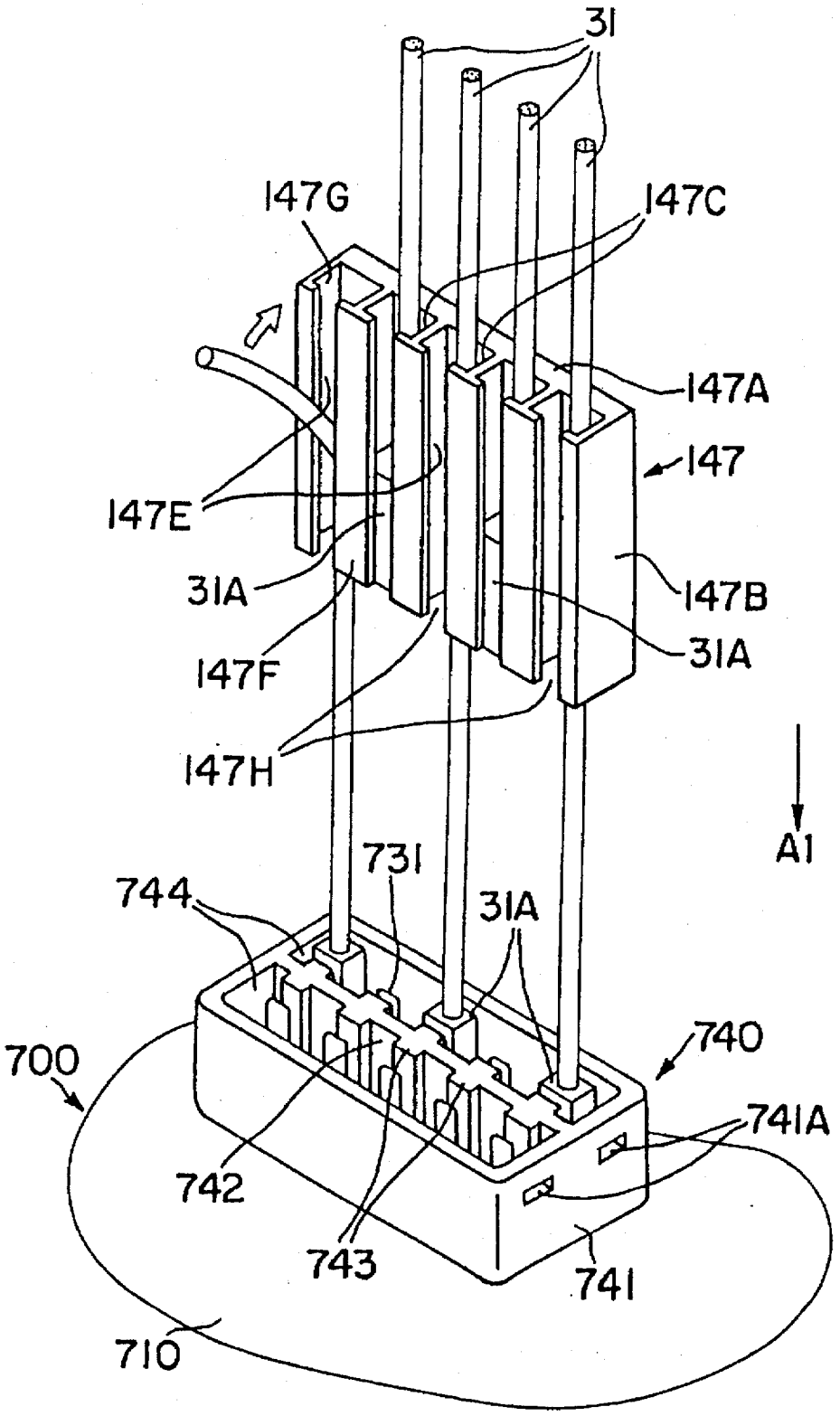
FIG. 12 is a perspective view, similar to that of FIG. 7, showing insertion of the jig wherein some terminals have previously been connected to their corresponding contacts.
Figure 13:
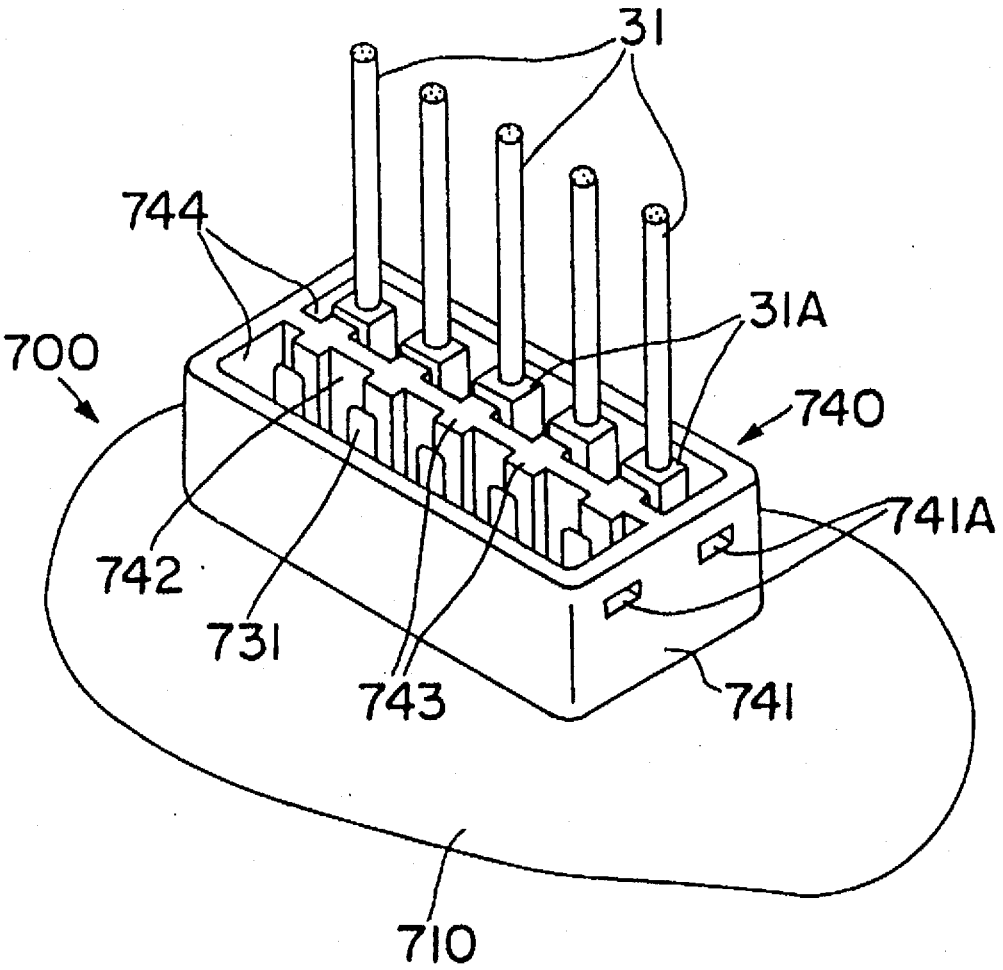
FIG. 13 is a perspective view showing the open component after all of the terminals have been connected to their contacts and the holding jig has been removed.

As shown in FIG. 12, when a second group of terminals 31A is inserted into chamber 744 into which a first group of terminals has already been inserted, cables 31 already connected to unit structure 700 via terminals 31A are led through gaps 147L into blank chambers 147E, after which terminal fittings may be inserted into unit structure 700. Holding jig 147 can consequently be guided to unit structure 700 without being hindered by cables 31 which have already been connected.

Figure 14:
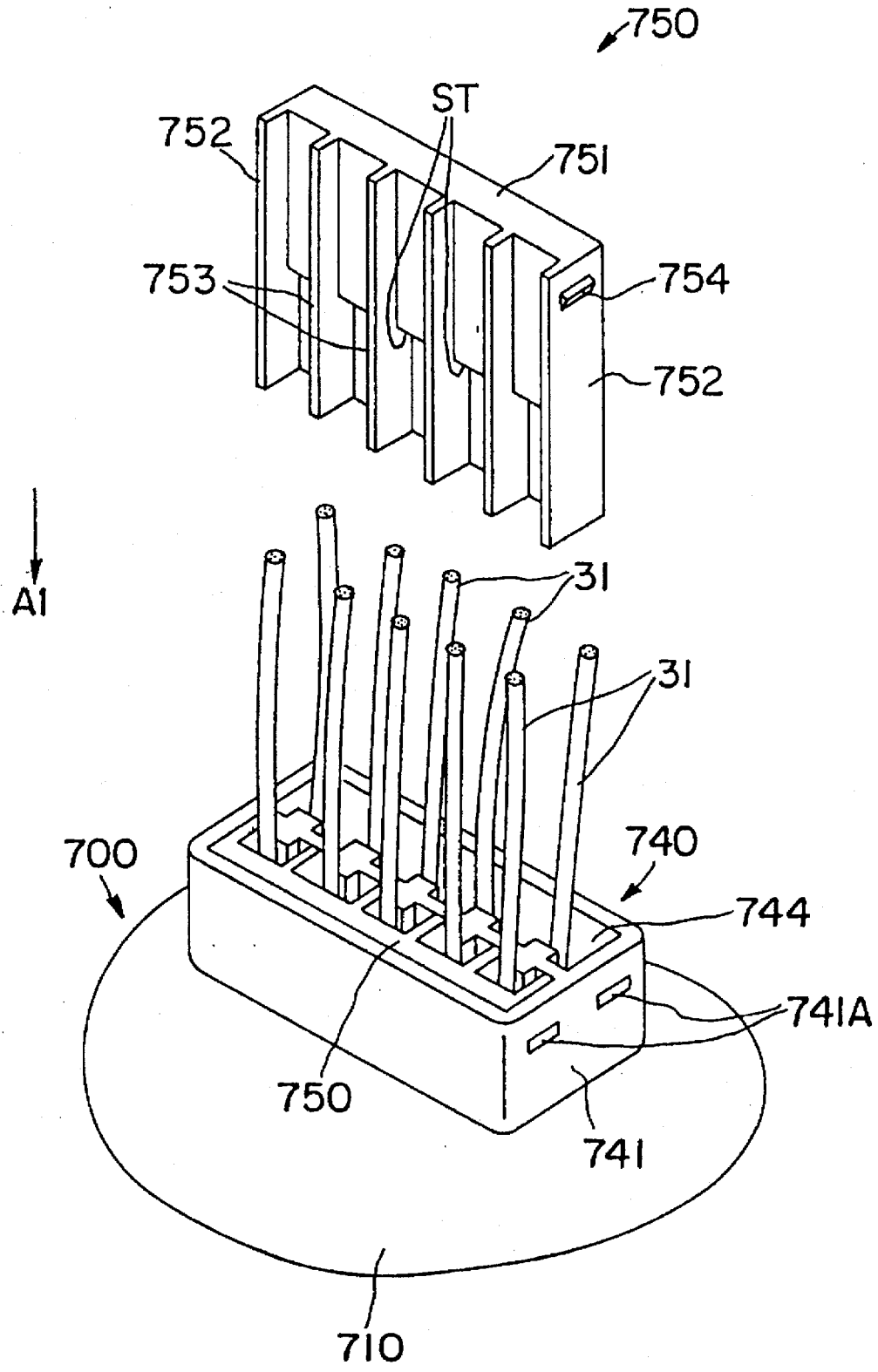
FIG. 14 is a perspective view showing the insertion of the retainer into the open component.
Figure 15:
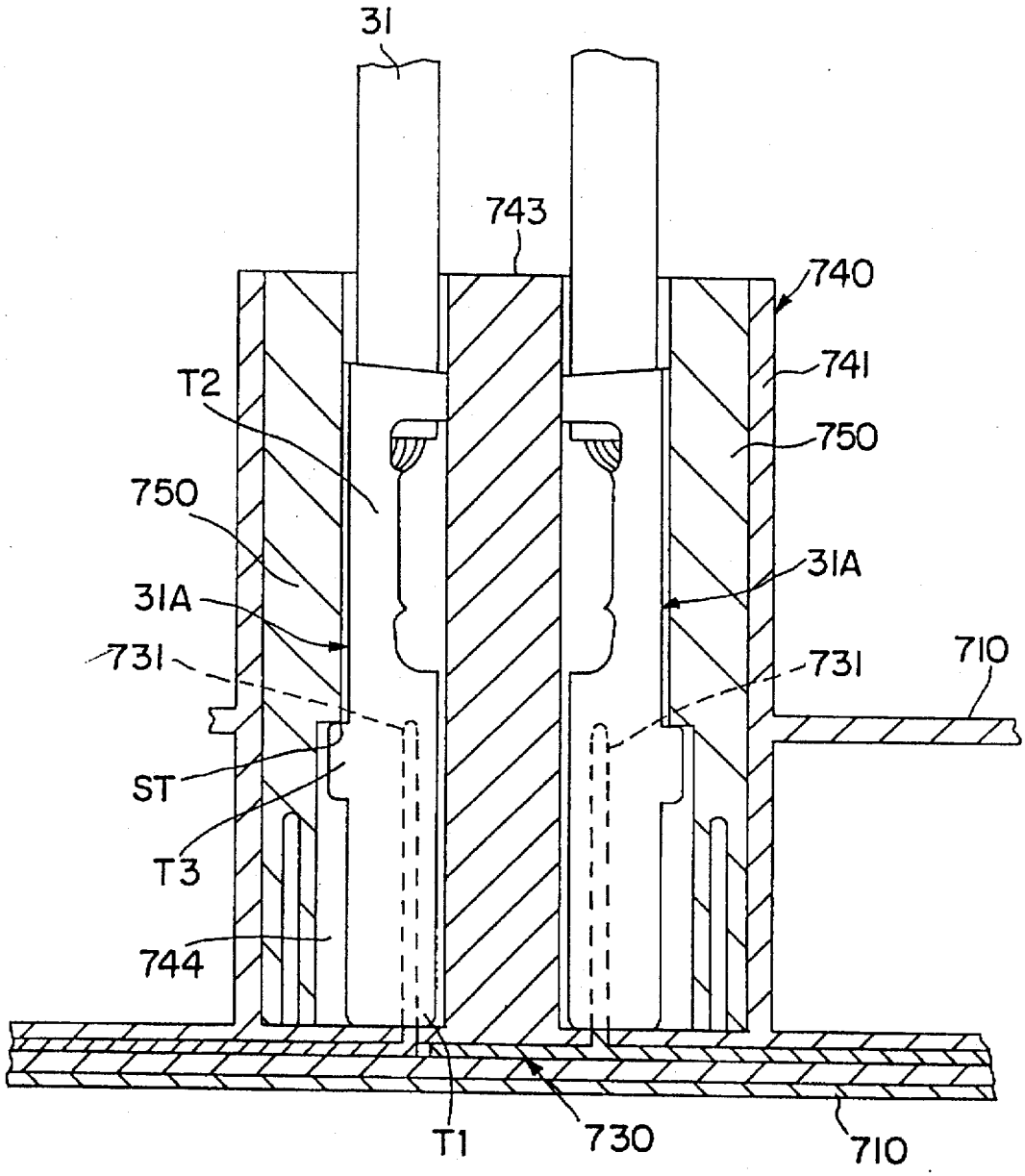
FIG. 15 is a cross-section of the completed unit structure with the retainer of FIG. 14 in its permanent position.

When the operation of inserting terminals 31A using holding jig 147 has been concluded, the attachment of retainer 750 to open component 740 holds terminals 31A in main casing 710. As shown in FIGS. 14 and 15, retainer 750 is integrally furnished with holder 751 which is substantially rectangular when viewed from the front. A pair of side walls 752 extend along both sides of holder 751, and partition walls 753 are arranged at intervals between side walls 752. Step ST faces columns 743 of open component 740 during attachment is formed between side walls 752 and partition walls 753, as well as between adjacent partition walls 753. Step ST comprises a thin lower side and a thick upper side of holder 751; stabilizers T3 of terminals 31A are pushed into chamber 744 of main casing 710 by step ST, whereby terminals 31A are structured so that they can be secured to main casing 710.

To prevent retainer 750 from releasing from main casing 710, latch 754 is integrally molded on the outside of both side walls 752 of the retainer 750, and stop hole 741A for engaging this latch is formed at a specified location on outer wall 741 of open component 740. Step ST of retainer 750 thus faces partition plate 742 of open component 740, so that, when retainer 750 is pushed in the direction of arrow A1, unit latch 754 engages stop hole 741A. Thus, retainer 750 acts in concert with open component 740 to hold terminals 31A in main casing 751.

With the structure of the Invention, those terminals 31A which are to be connected to contacts 731 of unit structure 700 are sorted and temporarily held in a detachable fashion by holding jig 147, which permits them to be arranged in a configuration which matches corresponding contacts 731. Terminals 31A are consequently arranged in their proper connection order, and are transferred in this configuration from holding jig 147 to contacts 731. This embodiment consequently prevents the erroneous arrangement of the terminal fittings and affords markedly improved operating characteristics.

Since this makes it possible to transfer terminals 31A to contacts 731 simply by introducing holding jig 147 into open component 740, it also allows the transfer process operation to be greatly enhanced. Furthermore, since no stop is needed on main casing 710, its shape is simplified, which facilitates molding and thus contributes to reduced costs. After terminals 31A have been connected to contacts 731, they can be retained in main casing 710. This embodiment facilitates the manufacture of unit structure 700, and affords improved operating characteristics.

While only a limited number of specific embodiments of the Invention have been expressly described, such changes as would suggest themselves to the person of ordinary skill may be made without departing from the scope thereof. For example, although a specific type of contact has been described for the unit structure, other types of contacts may be substituted. The terminal fittings, moreover, are not limited to female terminals, but may also be male terminals. Furthermore, open component 740 is shown herein on upper cover 700A of main casing 710, but it may also be on lower cover 710B. Whichever the case, since a stop member does not have to be provided on open component 740 itself, manufacture is readily accomplished.

What we claim is:

1. An electrically connected device comprising a plurality of terminals, each of which is in electrical contact with a different one of a plurality of cables, said cables being part of a wiring harness, a holding jig having a plurality of receiving chambers therein corresponding to said plurality of said terminals, a unit structure comprising an open component having a contact chamber containing a plurality of tab contacts disposed therein and complementary to said terminals, said plurality of receiving chambers corresponding to said plurality of tab contacts, said holding jig adapted to temporarily retain one of said terminals in each of said receiving chambers, said holding jig adapted to enter said contact chamber, thereby mating each of said terminals with one of said tab contacts, a retainer having a plurality of stops corresponding to said terminals and, after withdrawal of said jig from said contact chamber, adapted to enter said contact chamber and secure said terminals permanently in a fully mated position.

2. The device of claim 1 wherein each of said terminals is provided with guides, each of said stops comprising a step, said step adapted to bear against said guides.

3. The device of claim 1 wherein each of said terminals has a tip as its leading end, an abutment in said contact chamber, said tip bearing against said abutment when said terminals are in said fully mated position.

* * * * *